US010396472B2

(12) United States Patent
Baldauf et al.

(10) Patent No.: US 10,396,472 B2
(45) Date of Patent: Aug. 27, 2019

(54) CRIMPED AND WELDED CONNECTION

(71) Applicant: ROSENBERGER HOCHFREQUENZTECHNIK GMBH & CO. KG, Fridolfing (DE)

(72) Inventors: Walter Baldauf, Fridolfing (DE); Martin Hundseder, Traunreut (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/307,412

(22) PCT Filed: Apr. 16, 2015

(86) PCT No.: PCT/EP2015/000800
§ 371 (c)(1),
(2) Date: Oct. 28, 2016

(87) PCT Pub. No.: WO2015/165572
PCT Pub. Date: Nov. 5, 2015

(65) Prior Publication Data

US 2017/0069975 A1 Mar. 9, 2017

(30) Foreign Application Priority Data

Apr. 28, 2014 (DE) ..... 10 2014 006 244

(51) Int. Cl.

| | |
|---|---|
| ***H01R 4/02*** | (2006.01) |
| ***H01R 4/18*** | (2006.01) |
| ***H01R 4/62*** | (2006.01) |
| ***H01R 43/02*** | (2006.01) |
| *H01R 4/20* | (2006.01) |

(52) U.S. Cl.
CPC ..... *H01R 4/187* (2013.01); *H01R 4/625* (2013.01); *H01R 43/0207* (2013.01); *H01R 4/20* (2013.01)

(58) Field of Classification Search
CPC . H01R 4/20; H01R 4/62; H01R 43/16; H01R 43/058; H01R 4/184; H01R 43/048; H01R 4/18; H01R 4/183; H01R 4/186; H01R 4/10; H01R 4/22; H01R 9/0518; H01R 43/04
See application file for complete search history.

(56) References Cited

U.S. PATENT DOCUMENTS 2,385,792 A 10/1945 Carlson
2,965,147 A * 12/1960 Hoffman ..... H01R 4/20 29/282

(Continued)

FOREIGN PATENT DOCUMENTS

CN 201689998 U 12/2010
CN 102782942 A 11/2012

(Continued)

*Primary Examiner* — Xuong M Chung Trans
(74) *Attorney, Agent, or Firm* — DeLio Peterson & Curcio LLC; Robert Curcio

(57) ABSTRACT

A method for producing a permanent mechanical and electrical connection between a stranded wire and a connecting element, one end of the stranded wire being welded to the connecting element, the end of the stranded wire being introduced into a crimping recess of the connecting element prior to welding, and the connecting element being additionally crimped with the stranded wire. Crimped welded joints produced using this method are taught.

9 Claims, 2 Drawing Sheets

(56) References Cited

U.S. PATENT DOCUMENTS

| | | | | |
|---|---|---|---|---|
| 3,656,092 | A * | 4/1972 | Swengel, Sr. | H01R 4/723 439/730 |
| 3,717,842 | A | 2/1973 | Douglas | |
| 4,913,678 | A | 4/1990 | Avellino | |
| 7,033,233 | B2 * | 4/2006 | Fujimoto | B23H 11/006 439/874 |
| 7,303,450 | B2 * | 12/2007 | Roset | H01R 4/20 29/863 |
| 7,597,596 | B2 * | 10/2009 | Watanabe | H01R 4/183 439/877 |
| 7,695,331 | B2 * | 4/2010 | Kerner | H01R 4/20 174/15.6 |
| 7,896,712 | B2 * | 3/2011 | Cecil | H01R 4/20 439/730 |
| 8,118,209 | B2 * | 2/2012 | Ohnuma | H01R 4/023 228/110.1 |
| 9,601,889 | B2 * | 3/2017 | Ito | H01R 4/023 |
| 9,608,339 | B2 * | 3/2017 | Ito | H01R 4/20 |
| 2002/0050385 | A1 | 5/2002 | Murakami et al. | |
| 2009/0117787 | A1 | 5/2009 | Kerner | |

FOREIGN PATENT DOCUMENTS

| | | | |
|---|---|---|---|
| CN | 103038955 | A | 4/2013 |
| DE | 2544927 | A1 | 4/1977 |
| DE | 10007258 | A1 | 8/2001 |
| DE | 102008059481 | A1 | 6/2010 |
| DE | 102010031505 | A1 | 1/2012 |
| DE | 102013105669 | A1 | 12/2013 |
| EP | 2362491 | A1 | 8/2011 |
| GB | 2371418 | A | 7/2002 |
| JP | 2002124310 | A | 4/2002 |
| JP | 2003338330 | A | 11/2003 |
| JP | 2003338350 | | 11/2003 |
| JP | 2014-26904 | A | 2/2014 |
| JP | 2014-29792 | A | 2/2014 |
| WO | 2006134108 | A1 | 12/2006 |

* cited by examiner

CRIMPED AND WELDED CONNECTION

BACKGROUND OF THE INVENTION

1. Field of the Invention

The invention relates to a method for producing a permanent mechanical and electrical connection between a stranded wire and a connecting element. One end of the stranded wire is thereby welded to the connecting element. The invention also relates to a connection between a connecting element and a stranded wire produced using the method according to the invention 2. Description of Related Art A stranded wire or strand is a conductor consisting of a plurality of thin individual wires. The individual wires can be jointly surrounded coaxially by an insulating sheath and possibly additionally by a common outer conductor. Several such stranded wires can run next to one another in a cable.

Stranded wires have in common the advantage of particularly high flexibility and an only slight susceptibility to conductor breaks, even under mechanical stresses such as vibrations or shearing and bending forces acting on the stranded wire.

In order to connect the stranded wire with a connecting element such as a plug connector or a terminal it is known to provide a stripped end of the stranded wire with a ferrule which holds the individual wires of the strand firmly together and prevents damage to the individual wires being caused by a clamping screw or similar. The ferrule can for example be crimped together with the end of the stranded wire. As an alternative it is known for the strand to be soldered to a connecting element.

However, stranded wires or strands which are for example used for the transmission of high currents in automobiles generally have a large conductor cross section and a large number of individual wires, as a result of which the connection of the strand with the connecting element is made even more difficult. Moreover, the connection points are regularly subjected to high external forces such as vibrations, so that a particularly stable and durable fixing of the stranded wire to the connecting element is necessary.

At present, stranded wires with a large cross section or with a large number of individual wires are regularly welded to the connecting element, since a permanent substance-to-substance bond can be created quickly and comparatively economically by means of welding. For this purpose, the strand is laid on a flat contact surface of the connecting element, pressed flat in such a way that as many individual wires of the strand as possible are in direct contact with the contact surface, and the individual wires are then welded together with the contact surface. However, it has been found that such welded connections cannot be created with consistent resilience and durability due to the individual wires in some cases not being oriented in an ordered manner during welding, so that welded connections cannot always durably withstand the vibrations to which the connection point can be exposed.

It is known from EP 2 362 491 A1, U.S. Pat. No. 3,717,842 and DE 10 2013 105 669 A1 for a permanent mechanical and electrical connection between a stranded wire and a connecting element to be produced in that one end of the stranded wire is welded to the connecting element, whereby the end of the stranded wire is inserted in a crimping recess prior to welding and the connecting element is crimped together with the stranded wire.

SUMMARY OF THE INVENTION

In view of the problems described it is the object of the present invention to provide a method for creating a permanent mechanical and electrical connection between a stranded wire and a connecting element by means of which the stranded wire, with a large number of individual wires, can be reliably and durably fixed to the connecting element, even where the connection point is subjected to high loads.

This problem is solved by means of a method according to the independent claims. Advantageous further developments of the method are described in the dependent claims.

The above and other objects, which will be apparent to those skilled in the art, are achieved in the present invention which is directed to a method for producing a permanent mechanical and electrical connection between a stranded wire and a connecting element, in which one end of the stranded wire is welded to the connecting element, wherein, prior to welding, the end of the stranded wire is inserted into a crimping recess of the connecting element and that the connecting element is crimped together with the stranded wire, such that the connecting element is crimped with the stranded wire in a gas-tight manner by an insulation crimp consisting of at least a part of a sheath of the stranded wire.

The method further includes first crimping together the connecting element with the stranded wire in order to provide a crimped connection, and then welding the crimped connection in order to provide a crimped and welded connection. Welding the crimped connection is preferably performed by ultrasound.

The end of the stranded wire is inserted into a substantially cylindrical blind hole of the connecting element. A peripheral press force (F) is then provided, during crimping, to a side wall of the blind hole, so that the individual wires of the stranded wire are substantially evenly compressed.

In a second aspect, the present invention is directed to a crimped and welded connection formed between a stranded wire and a connecting element, in which one end of the stranded wire is welded to the connecting element, wherein, prior to welding, the end of the stranded wire is inserted into a crimping recess of the connecting element and that the connecting element is crimped together with the stranded wire, such that the connecting element is crimped with the stranded wire in a gas-tight manner by an insulation crimp consisting of at least a part of a sheath of the stranded wire.

The stranded wire comprises individual wires made of aluminum and/or the connecting element is at least partially formed of copper, or vice versa.

The connecting element is a plug connector for electrically connecting the stranded wire with a mating plug connector, whereby the plug connector has a socket-formed plugging geometry on one side of the crimping recess and/or on the opposite side.

The stranded wire includes a cross-sectional surface area of more than 20 $mm^2$, or more than 40 $mm^2$, or greater than or equal to 50 $mm^2$, and/or comprises more than 100, or 200 or more individual wires.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
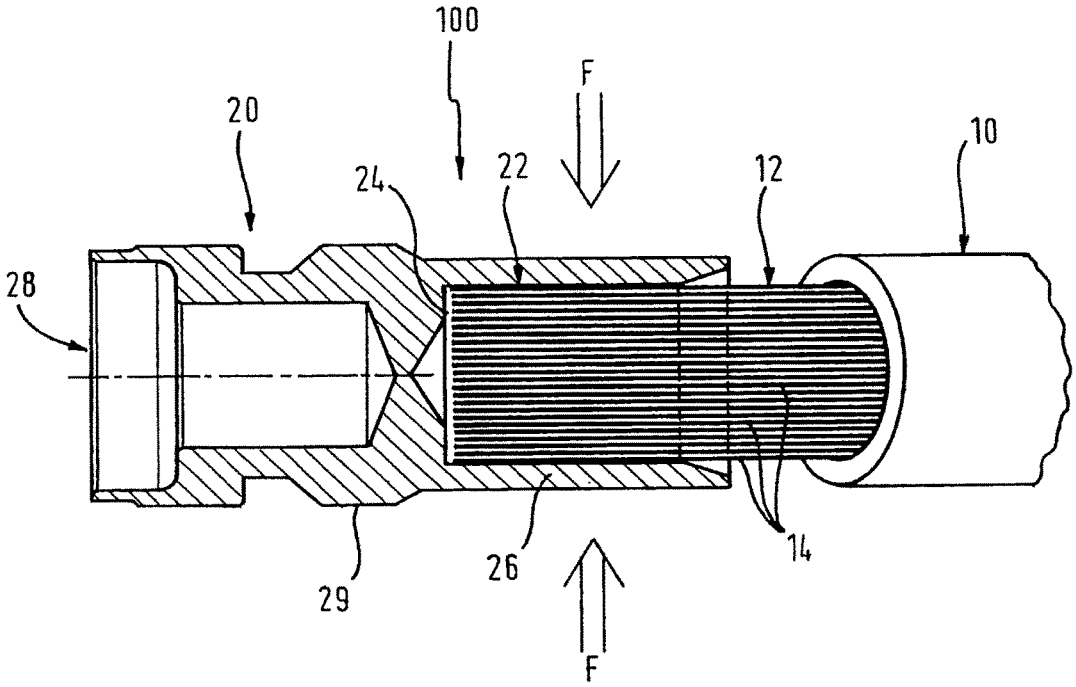
FIG. 1 shows a diagrammatic sectional view of a crimped and welded connection according to the invention.

In describing the preferred embodiment of the present invention, reference will be made herein to FIGS. 1-3 of the drawings in which like numerals refer to like features of the invention.

According to the invention, the connecting element is both crimped onto the stranded wire as well as being additionally welded together with the stranded wire. For this purpose, the connecting element has a crimping recess into which one end of the stranded wire is introduced prior to crimping or prior to welding. In other words, according to the invention the stranded wire is not welded to a flat contact surface; instead it is attached to a side wall of the crimping recess surrounding it in a peripheral direction.

The connection is sealed (liquid-tight and/or gas-tight) by means of an insulation crimp in the entry region of the crimping recess. The insulation crimp can be formed by at least a part of a sheath of the stranded wire and/or another sealing element attached to the stranded wire which is introduced, in sections, into the crimping recess and crimped along with the stranded wire.

The invention is based on the knowledge that, where the stranded wire only contacts a contact surface of the connecting element on one side, numerous individual wires are not directly bonded to the connecting element during welding, which adversely affects the attachment strength. The attachment strength can be improved through the side wall of the crimping recess which surrounds the stranded wire according to the invention. The contact resistance can also be reduced through the contact taking place over a comparatively large surface area. Finally, the fact that the stranded wire is held in a crimping recess during welding prevents an undesired flow of conductor material onto the contact surface before the individual wires of the stranded wire are bonded adequately to the contact surface.

The invention is also based on the knowledge that, where the stranded wire which is to be crimped comprises a large number of individual wires, in order to create a purely force-locking connection such as a crimped connection considerable press forces need to be applied in order to achieve a desired plastic deformation of the individual wires over the entire conductor diameter. For this reason, pure crimped connections in stranded wires with a large cross section are complex to manufacture and not sufficiently reliable. In contrast, according to the invention the crimped connection, which acts in a force-locking manner, and the welded connection, which represents a substance-to-substance-bond, complement each other optimally, since the individual wires, which are already compressed together following the crimping procedure, fuse together without requiring a complex welding process and with only a short welding time in order to create a substance-to-substance-bonded connection, without conductor material flowing out of the crimping recess during welding.

Preferably, the stranded wire has a diameter of more than 0.5 cm, in particular 1 cm or more and/or a strand cross-sectional surface area of more than 20 $mm^2$, preferably more than 40 $mm^2$, in particular 50 $mm^2$ or more. However, the stranded wire is not necessarily round and can also be in the form of an oval or flat stranded wire. The stranded wire can thereby consist of more than 100, preferably more than 200, in particular 250 or more individual wires running next to one another. Such a stranded wire can be designed for current strengths of more than 50 A, in particular 100 A or more, such as occur when used in automobile applications.

The crimping recess is preferably substantially cylindrical and is adapted to the diameter of the stranded wire. It can be surrounded by a thin, preferably substantially cylinder-jacket-formed side wall, so that, by applying a pressing force from outside, it is possible to mould the side wall to the form of the individual wires of the stranded wire arranged in the recess.

In terms of increasing process reliability it has proved advantageous first to crimp the connecting element together with the stranded wire in order to provide a crimped connection and then to weld the finished crimped connection in order to provide a crimped and welded connection.

In other words, the connection is first crimped and then welded because, through the crimping procedure, in which the end of the stranded wire, introduced into the crimping recess, is compressed through application of a predetermined radial press force and as a consequence the individual wires are plastically deformed, a predetermined starting position for the subsequent welding process can be provided depending on the press force applied. In other words, following the crimping process, the individual wires of the stranded wire are no longer arranged randomly and in a comparatively disordered manner in the crimping recess, but with a defined and predetermined press dimension. This leads to a repeatably manufacturable strength of crimped and welded connections according to the invention.

Moreover, less welding or a lesser input of energy and/or a shorter welding time are necessary in order to create an already-created crimped connection due to the "pre-compression" which is already present in this case, so that the crimped contact is not subjected to an excessively high loading through the welding process.

Preferably, the crimped connection is welded by means of ultrasound. The energy required for welding is generated through a high-frequency mechanical vibration which is generated between the components which are to be welded through friction. At the same time, any oxide coating on the surfaces of the components which are to be connected is broken up through this friction. Ultrasound welding is characterized by a comparatively short welding time. The ultrasound waves can also readily be applied to the connecting element and thus introduced into the crimping recess from the outside.

In order to achieve a robust and durable connection it has proved practical for the connecting element to be crimped together with the stranded wire in a gas-tight manner. For this purpose, the stranded wire is crimped so firmly with the connecting element that neither a liquid nor a gaseous medium can penetrate from outside into the crimp, so that oxidation between the pressed individual wires and an associated increase in the contact resistance can be ruled out. The voids still present between the crimped individual wires are thus not in fluid connection with the environment. A gas-tight crimp can be ensured through a sufficiently high press force acting externally from several sides on the cylindrical side wall of the crimping recess. As a result, the individual wires are evenly pressed together and compressed.

Before crimping, the end of the stranded wire is preferably stripped of its insulation and then introduced into a preferably substantially cylindrical blind hole of the connecting element. Advantageously, the stranded wire is inserted so far into the blind hole that the front ends of the individual wires come to rest against the base of the blind hole. Unlike when using a sleeve-formed connecting part with a through-opening, where a blind hole is used there is no danger that conductor material can leak out or that conductor material can adhere to the sonotrode of the welding device during welding, since the blind hole only has a single opening. The blind hole can also seal off the connection point from environmental influences.

According to a further aspect, the invention relates to a crimped and welded connection produced using the method according to the invention. Such a crimped and welded connection is characterized by one end of a stranded wire engaging in a crimping recess of a connecting element such as a plug connector, whereby the stranded wire and the connecting element are crimped together and welded together.

Advantageously, during the course of its manufacture the crimped and welded connection according to the invention is first crimped and then welded. Such a crimped and welded connection is characterized through there being practically no voids between the individual wires and by a particularly even compression.

As explained above, the stranded wire can be designed to transmit high currents and can have a cross-sectional surface area of more than 20 $mm^2$, preferably more than 40 $mm^2$, in particular 50 $mm^2$ or more and/or more than 100, in particular 200 or more individual wires.

The individual wires of the stranded wire are preferably formed of aluminum Alternatively or additionally, the connecting element, in particular the side wall of the crimping recess with which the stranded wire is in contact, is at least partially fanned of copper. In the case of components formed of different metals which are to be connected together, a crimped and welded connection which is both force-locking and also substance-to-substance-bonded is particularly advantageous in terms of increasing attachment strength.

The connecting element can be designed as a plug connector for electrically connecting the stranded wire with a mating plug connector, whereby the plug connector has a preferably socket-formed plugging geometry on one side of the crimping recess and/or on the opposite side.

The crimped and welded connection according to the invention is characterized in particular through the following properties: even strand compression, gas-tight connection, preferably without voids in the crimp, improved contact resistances and/or improved surface structure of the contact.

FIG. 1 shows a substantially rotationally symmetrical connecting element 100 in the form of a plug connector, whereby the connecting element 100 has a crimping recess 22 into which one end 12 of a stranded wire 10 is inserted. The crimping recess 22 is formed on a side facing the stranded wire 10 in the form of a substantially cylindrical blind hole 24 in the connecting element 100. On the side facing away from the blind hole 24 the connecting element 100 has a socket-formed plugging geometry 28 for connecting the connecting element 100 with a mating plug connector (not shown).

The blind hole 24 is surrounded by a relatively thin side wall 26 to which press forces F acting radially inwards can be applied during crimping. A thin side wall offers the further advantage that it is possible to introduce vibrations into the blind hole 24 more effectively during welding.

The crimping recess is not necessarily designed in the form of a cylindrical blind hole and, alternatively, it can also be non-rotationally-symmetrical and/or in the form of a through-hole. However, a round cross section geometry facilitates the crimping process and leads to a particularly even compression of the stranded wire. Unlike a through-hole, with a blind hole molten conductor material is prevented from flowing out during welding.

An outer boundary surface of the connecting element 100 can be foamed optimally for crimping. In the embodiment represented in FIG. 1 the outer boundary surface has an intermediate section, following on from the side wall 26 of the blind hole 24 and widening conically, which transitions into a transitional region 29 with expanded diameter. The transitional region 29 provides a sufficient volume of material to permit a deformation of the side wall 26 in an inward radial direction during crimping. The conically-formed intermediate section minimizes cracks and other damage to the material during crimping and/or during welding.

The plugging geometry 28 is represented as a socket purely by way of example. Alternatively, the plugging geometry can also be in the form of a plug. Also alternatively, the connecting element can be designed not as a plug connector but as part of a housing or of another contact element.

The stranded wire 10 represented in FIG. 1 has a large number of conductive individual wires 14 which are surrounded by a common sheath. At the end of the stranded wire 10, which is inserted in the crimping recess 22, the sheath is stripped so that the individual wires are in contact with the inner surface of the side wall 26 of the blind hole 24. Alternatively or additionally, at least a part of the sheath and/or of another sealing element is, at least in sections, inserted in the blind hole and crimped together with the stranded wire, so that an insulation crimp is produced. The insulation crimp can also be created in an additional crimping procedure as a further cable-side crimped connection. As a result, the connection is sealed on the cable side through the crimp and at the front end through the blind hole.

In total, the stranded wire 10 comprises around 250 individual wires. The cross-sectional surface area formed collectively by the individual wires (referred to in the present case as the cross section of the stranded wire) amounts to around 50 $mm^2$.

Alternatively or additionally, the stranded wire can be surrounded by a common shield and/or an outer sheath. Alternatively or additionally, the individual wires can each have an insulating coating.

The individual wires 14 of the stranded wire are substantially formed of aluminum and the connecting element 20 consists substantially of copper. Other, not necessarily different conductive materials are also conceivable.

The individual method steps for manufacturing the illustrated crimped and welded connection are explained in the following:

First, the stripped end 12 of the stranded wire 10 is inserted into the blind hole 24 until the front ends of the individual wires come to rest against the base of the blind hole 24.

Then, in order to crimp the stranded wire, a press force F is applied radially from the outside to the side wall 26 of the blind hole. The press force F acts on the side wall 26 from several sides, in particular peripherally, in order to achieve as even as possible a compression of the individual wires 14 and pressing of these against the side wall 26. The individual wires 14 are deformed in such a way that only few voids are present between the individual wires within the blind hole 24. The press force F is dimensioned such that a gas-tight crimp is produced.

Figure 2A:
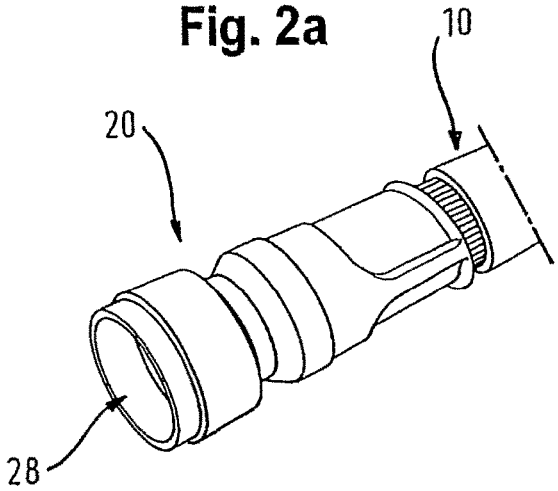
FIG. 2*a* shows a perspective view of a crimped connection prior to the welding process.
Figure 2B:
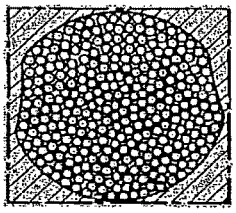
FIG. 2*b* shows a sectional view of a stranded wire after crimping but before welding.
Figure 3A:
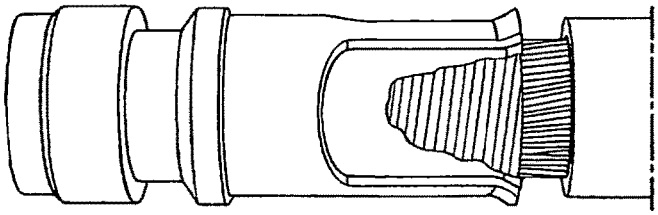
FIG. 3*a* shows a side view of a crimped and welded connection according to the invention.

The resulting crimped connection is represented in FIG. 2*a* and FIG. 2*b* in a perspective view and in a sectional view. FIG. 2*b* shows particularly clearly how the individual wires 14 of the stranded wire 10 are pressed closely together.

Then ultrasound waves are introduced from outside into the finished crimped connection in order to weld it. As a result, the individual wires 14 which lie in close contact with one another fuse together with one another and with the inner surface of the side wall 26 of the blind hole. A form-locking connection practically without voids between the individual wires 14 of the stranded wire is produced, as shown in cross section in FIG. 3*b* and in a side view in FIG. 3*a*. A comparatively low welding energy is sufficient for this purpose, since the connection is already "pre-compressed" through the crimping.

Since the blind hole 24 is sealed at the bottom, there is no danger of conductor material leaking out.

Figure 3B:
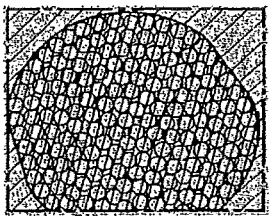
FIG. 3*b* shows a sectional view through a crimped and welded connection produced using a method according to the invention.

A comparison of FIGS. 2*b* and 3*b* shows particularly clearly that a simple crimped connection differs clearly from the crimped and welded connection according to the invention.

Alternatively, a welding method other than ultrasound welding can be used.

Tests have shown that the contact resistances of the connection according to the invention are significantly lower than in the case of a simple welded connection which has not been crimped beforehand.

It has also been found that the connection can absorb tensile forces on the stranded wire of 3 kN without any problem, whereas conventional welded connections are regularly designed for a maximum tensile force of around 1.8 kN.

The crimped and welded connection achieves approximately the tensile strength of the remaining part of the stranded wire or of the cable. In a pure welded connection, the pull-out strength is significantly lower.

LIST OF REFERENCE NUMBERS

10 stranded wire
12 end of the stranded wire
14 individual wires of the stranded wire
20 connecting element
22 crimping recess
24 blind hole
26 side wall of the blind hole
28 plugging geometry
29 transitional region
100 crimped and welded connection
F press force While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for producing a permanent mechanical and electrical connection between a stranded wire and a connecting element, in which one end of the stranded wire is welded to the connecting element, wherein, prior to welding, the end of the stranded wire is inserted into a blind hole of the connecting element and that the connecting element is crimped together with the stranded wire, such that the connecting element is crimped with the stranded wire in a gas-tight manner by an insulation crimp, wherein the stranded wire comprises individual wires made of aluminum, and a surface of a side wall of the blind hole with which the stranded wire is in contact is at least partially formed of copper.

2. The method of claim 1, including first crimping together the connecting element with the stranded wire in order to provide a crimped connection, and then welding the finished crimped connection in order to provide a crimped and welded connection.

3. The method of claim 1, including welding the crimped connection by ultrasound.

4. The method of claim 1 wherein the blind hole is a substantially cylindrical blind hole.

5. The method of claim 4, including providing, during crimping, a peripheral press force (F) to a side wall of the blind hole, so that the individual wires of the stranded wire are evenly compressed.

6. The method of claim 2, including welding the crimped connection by ultrasound.

7. A crimped and welded connection formed between a stranded wire and a connecting element, in which one end of the stranded wire is welded to the connecting element, wherein, prior to welding, the end of the stranded wire is inserted into a blind hole of the connecting element and that the connecting element is crimped together with the stranded wire, such that the connecting element is crimped with the stranded wire in a gas-tight manner by an insulation crimp, wherein the stranded wire comprises individual wires made of aluminum, and a side wall of the blind hole with which the stranded wire is in contact is at least partially formed of copper.

8. The crimped and welded connection of claim 7 wherein the connecting element is a plug connector for electrically connecting the stranded wire with a mating plug connector, whereby the plug connector has a socket-formed plugging geometry on one side of the crimping recess and/or on the opposite side.

9. The crimped and welded connection of claim 7, wherein the stranded wire includes a cross-sectional surface area of more than 20 $mm^2$, or more than 40 $mm^2$, or greater than or equal to 50 $mm^2$, and/or comprises more than 100 or 200 or more individual wires.

* * * * *